US007017369B2

(12) United States Patent
Roberts-Shea

(10) Patent No.: US 7,017,369 B2
(45) Date of Patent: Mar. 28, 2006

(54) ORNAMENTAL RING AND ASSEMBLY METHOD

(76) Inventor: Marthe Roberts-Shea, 7734 Union Ave., Elkins Park, PA (US) 19027

( * ) Notice: Subject to any disclaimer, the term of this patent is extended or adjusted under 35 U.S.C. 154(b) by 0 days.

(21) Appl. No.: 10/863,964

(22) Filed: Jun. 9, 2004

(65) Prior Publication Data

US 2005/0274143 A1 Dec. 15, 2005

(51) Int. Cl.
*A44C 19/00* (2006.01)
*A44C 5/00* (2006.01)
*A44C 17/02* (2006.01)

(52) U.S. Cl. ..... 63/15; 63/3; 63/31

(58) Field of Classification Search ..... 63/15, 63/15.1–15.9, 3, 13, 31; D11/2, 35, 79
See application file for complete search history.

(56) References Cited

U.S. PATENT DOCUMENTS 1,548,645 A * 8/1925 Anders ..... 63/15
1,855,066 A * 4/1932 Peters ..... 63/15
1,920,875 A * 8/1933 Miskend ..... 63/16
2,637,884 A * 5/1953 Morehouse ..... 24/336
3,347,037 A * 10/1967 Klang ..... 63/21
3,959,989 A * 6/1976 Bhandia ..... 63/15.65
3,974,545 A * 8/1976 Lossini ..... 24/116 R
4,220,017 A * 9/1980 Freeman ..... 63/15
D272,609 S * 2/1984 Ofiesh, II ..... D11/2
4,726,200 A * 2/1988 Carter ..... 63/15
4,977,757 A * 12/1990 Mesica et al. ..... 63/15
D337,547 S * 7/1993 Keshishian ..... D11/93
5,440,900 A * 8/1995 White ..... 63/38
5,491,986 A * 2/1996 White ..... 63/29.1
D388,016 S * 12/1997 Kejejian ..... D11/91
5,996,374 A * 12/1999 Bardisbanyan ..... 63/15
6,227,006 B1 * 5/2001 Pantet ..... 63/3
D448,318 S * 9/2001 Chia et al. ..... D11/93
D469,717 S * 2/2003 Chia et al. ..... D11/93
6,694,779 B1 * 2/2004 Dreger ..... 63/33

* cited by examiner

*Primary Examiner*—J J Swann
*Assistant Examiner*—David Reese
(74) *Attorney, Agent, or Firm*—Roberts Abokhair & Mardula, LLC

(57) ABSTRACT

A jewelry ring and an associated assembly method involves the ring being assembled with a set of easily fabricated components that allow for mass production, easy custom fabrication, and use in hobby kits. The ring employs a U-shaped shank formed of sheet material and a bezel formed of sheet material that are attached to each other in a manner that imparts the ability for the bezel "float." The bezel has an upper portion formed with sheet material to provide for ornamentation with designs or gemstones. The bezel further includes a lower portion that has a plurality of parallel ferrules. The shank includes a plurality of holes in each end and the bezel is attached to the shank with bars or wires that are inserted through one end of the shank, through the ferrules and through the other end of the shank and secured with retainers.

10 Claims, 6 Drawing Sheets

ORNAMENTAL RING AND ASSEMBLY METHOD

BACKGROUND OF THE INVENTION

Ornamental rings such as finger rings have been used since before recorded history. In modern times, jewelers have typically employed various casting techniques to make custom rings, but generally the shank and bezel of the ring are rigidly secured to each other such that if the bezel or jewel it is holding is jarred, the shank is twisted in an uncomfortable manner on the wearer's finger. Additionally, a high level of skill has generally been required to make custom rings.

BRIEF SUMMARY OF THE INVENTION

The present invention is drawn to a jewelry ring and an associated assembly method. The ring is assembled with a set of components that allow for mass production, custom fabrication, and use in hobby kits as well as use in high end jewelry production. The ring employs a U-shaped shank formed of sheet material and a bezel formed of sheet material that are attached to each other in a manner that imparts the ability for the bezel "float," but not substantially rotate. The bezel has an upper portion formed with sheet material to provide for ornamentation with designs or gemstones. The bezel further comprises a lower portion that has a plurality of parallel ferrules. The shank includes a plurality of holes in each end and the bezel is attached to the shank with bars or wires (collectively "bars") that are inserted through one end of the shank, through the ferrules and through the other end of the shank. Retainers at either end of the bars secure the ring in its assembled state that allows the bezel to "float" or slide a small amount on the bars, yet inhibit rotation due to the fixed locations of the plurality of holes.

Rings of various sizes can be produced by varying the dimensions of the shank and/or the length of the bars. Similarly, ring designs can be varied or customized by varying the materials, varying the surface pattern of the sheet material on the shank, varying the ornamentation on the shank, varying the ornamentation of the retainers on the bars, and varying the ornamental aspect of the upper portion of the bezel.

Although silver and gold are the preferred materials for the ring components, any suitable material can be used, including, but not limited to, metals such as stainless steel, platinum, titanium, aluminum, nickel, copper, zinc, and combinations and alloys thereof, as well as plastics and wood. Furthermore, although disclosed with reference to a finger ring, the present invention can also find utility for toe rings, bracelets, and napkin rings.

The present invention provides for a ring that can be constructed by individuals of varying skill levels.

It is another aspect of the present invention to provide a ring that can be fabricated using pre-finished sheet materials.

The present invention also allows various components of the ring to be prefabricated and made available to jewelers, artists, and hobbyists.

The present invention also provides a ring having superior comfort due to the floating bezel.

It is another aspect of the present invention to provide a ring that employs an independent bezel that allows for a variety of ornamentation.

The present invention also employs an independent shank that allows for a variety of ornamentation.

DETAILED DESCRIPTION OF THE INVENTION

Figure 1:
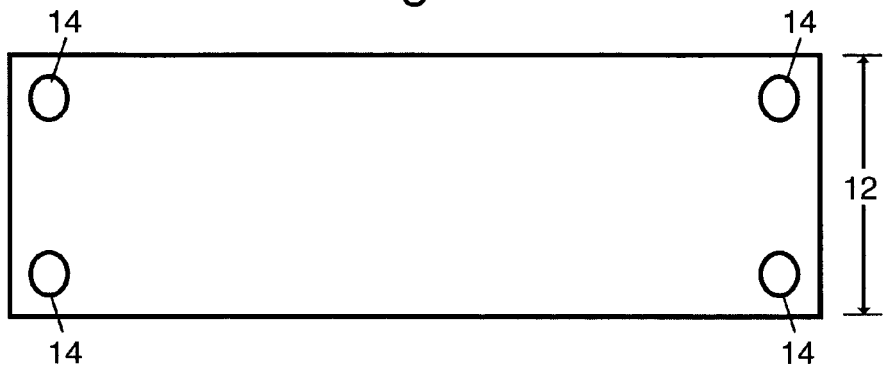
FIG. 1 illustrates a basic shank element of the present invention.

The ring of the present invention is assembled with a set of fabricated components that allow for mass production,—custom fabrication, and use in hobby kits as well as use in high end jewelry production. As illustrated in FIG. 1, the ring employs a shank 10 formed of sheet material. In one preferred embodiment, the sheet material is 22–24 gauge pre-finished silver sheet. Although illustrated as having a uniform width 12, this is not a limitation of the shank 10, which can vary in width. The shank 10 also includes a plurality of holes 14 at each end. Although illustrated as circular, this is not meant as a limitation. The holes 14 can have any shape that is suitable for allowing a rod or wire to pass through, but not allow a retainer to pass through. The holes 14 can include adjacent countersunk or recessed portions (not shown) for engaging various retainers.

The shank 10 can be made of any suitable material, and is preferably formed from pre-finished gold or silver sheet material, including, but not limited to, polished finishes, embossed finishes, rolled or stamped finished, chemically-induced patina finishes, brushed finishes, etched finishes, anodized finishes, painted or enameled finishes, and various combinations thereof. However, this is not meant as a limitation and the shank 10 can employ any suitable sheet material, pre-finished or not, and use any suitable method for ornamentation, as is well known in the art of jewelry making.

Figure 2A:
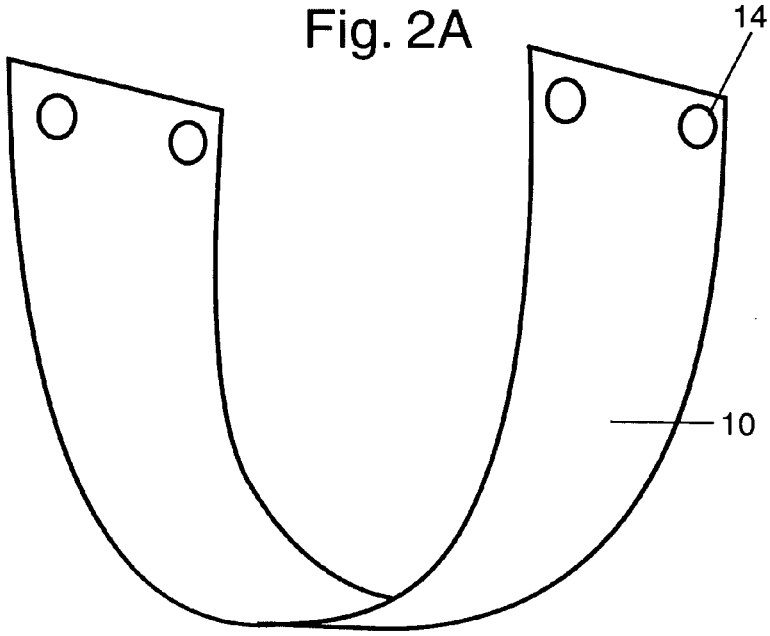
FIG. 2 illustrates a basic shank element of the present invention in its bent configuration.
Figure 2B:
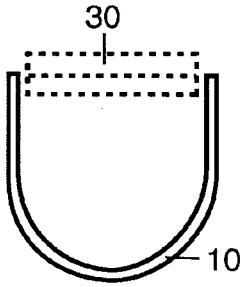
Figure 2C:
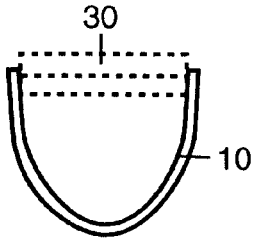
Figure 2D:
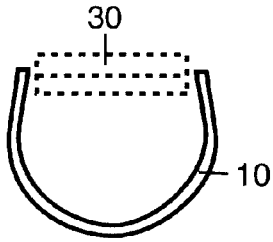
Figure 2E:
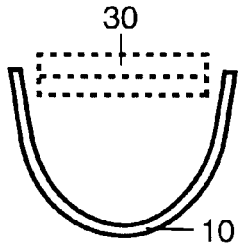

As illustrated in FIGS. 2A–E, the shank 10 is bent into a substantially U-shaped configuration and can be variously sized and shaped to fit a variety of finger sizes and bezel sizes. The exact shape of the bend is determined by the length of the shank 10, the size of the bezel (30, shown in phantom), the amount of desired "float," and the size of the wearer's finger. As shown in FIGS. 2B and 2C, the same bezel 30 can be used for various finger sizes by altering the size or bend of the shank 10. As shown in FIGS. 2D and 2E, altering the shank 10 and/or its bend can be used to provide a different amount of float to the same bezel 30.

Figure 3A:
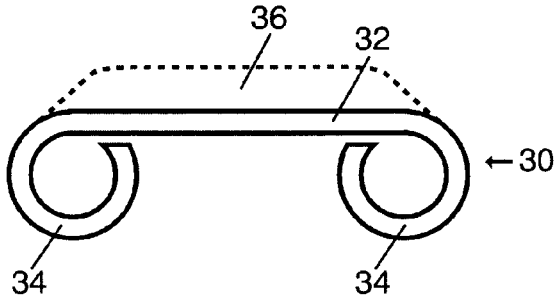
FIGS. 3A and 3B illustrate a basic bezel element of the present invention.
Figure 3B:
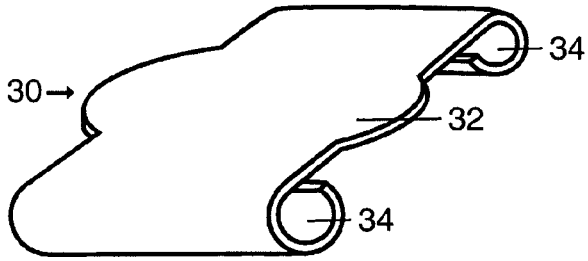

The bezel of the present invention is also preferably formed of sheet material. As illustrated in FIGS. 3A–B, a basic form of bezel 30 can be made of a single piece of sheet material that includes a portion 32 with a top face for the provision or application of ornamentation, and a pair of rolled portions on a lower portion that form ferrules 34. The ferrules 34 are positioned to provide an interconnection between the plurality of holes 14 in each end of the U-shaped shank 10. Although the ferrules 34 are preferably parallel in order to allow the bezel 30 to float, this is not meant as a limitation since the only requirement of the ferrules 34 is to guide the bars 42 that attach the bezel to the shank. In this form, the bezel 30 can be used to mount a plaque-type jewelry element 36, such as school insignia, initials, cameos, etc. As appropriate, these elements 36 can be glued to the bezel 30, soldered to the bezel 30, formed integrally into the sheet material of the bezel 30, or attached to the bezel 30 by other mechanical means. For example, for hobbyists that do beading, a pin and hole can be used to attach an ornamental bead-type element to the bezel 30 via a hole in the bezel 30.

Figure 4:
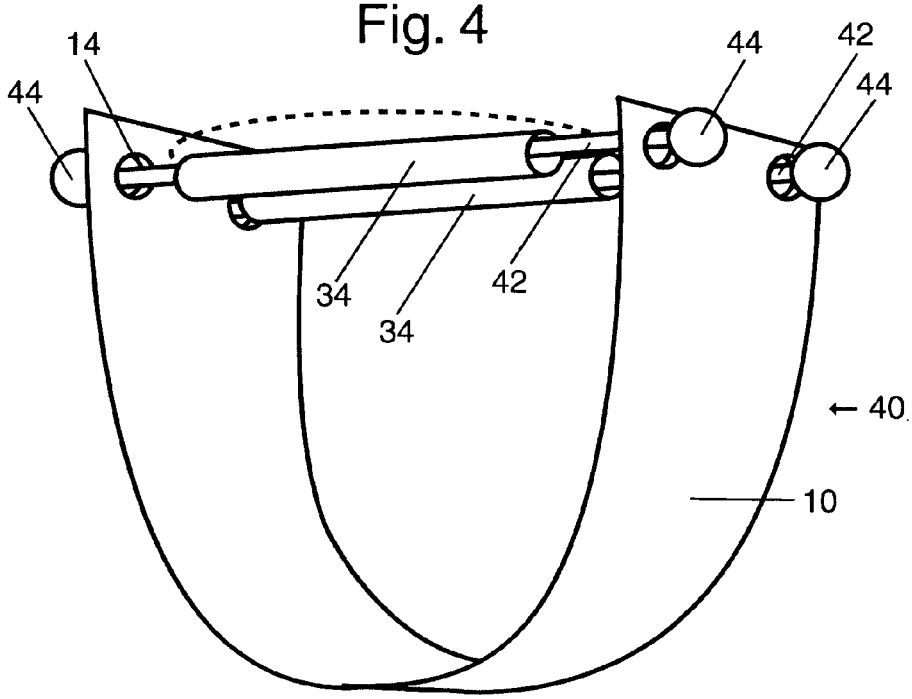
FIG. 4 illustrates a basic embodiment of the present invention

As illustrated in FIG. 4, a basic ring 40 in accordance with the present invention can be formed by attaching the shank 10 to the bezel 30 by inserting bars 42 transversely through the holes 14 and ferrules 34 and securing the bars 42 in place using retainers 44. Although illustrated as balls, the exact configuration of the retainers 44 is not meant to be a limitation. The retainers, as illustrated in FIGS. 7A–E can take many forms, including but not limited to, bent portions 7A, flat heads 7B–7C of any shape, and various geometric shapes 7D–E. Although in a preferred embodiment the retainers 44 are melted portions of gold or silver, the retainers 44 can be formed in any suitable manner, including having one retainer integrally formed with the bars 42 and the other attached by known means such as screw and thread, solder and hole, etc.

The use of bars 42 to attach the shank 10 to the bezel 30 imparts the ability for the bezel "float" which, as previously mentioned, adds to the comfort of wearing the ring.

Figure 5:
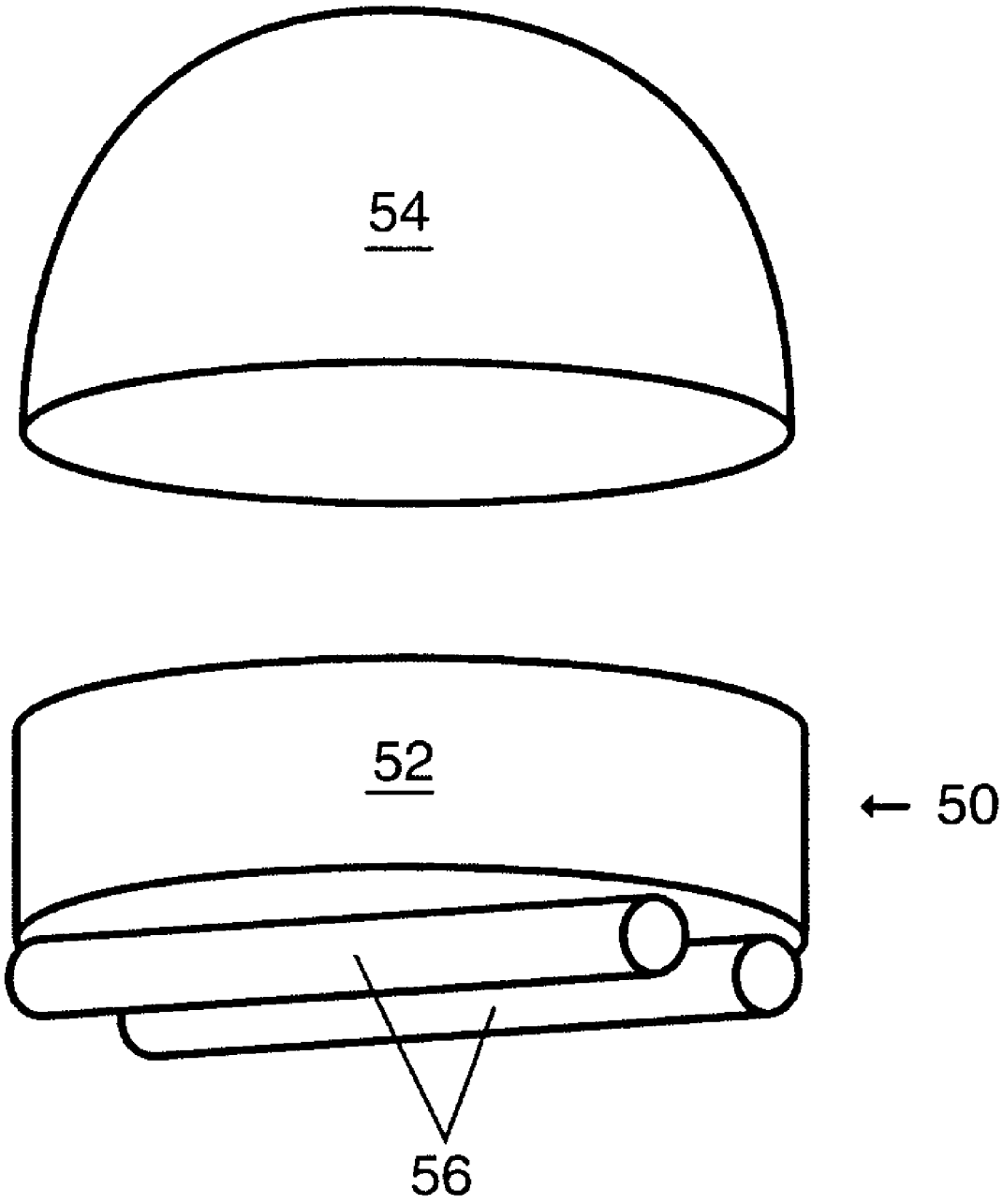
FIG. 5 illustrates an alternate bezel element of the present invention.

Another embodiment of the bezel is illustrated in FIG. 5. In this embodiment, a more conventional bezel 50 is formed with sheet material 52 that encompasses a lower portion of the gem 54. The bezel 50 in this embodiment includes a lower portion that has a plurality of parallel ferrules 56 attached thereto. In a preferred embodiment, the ferrules 56 are formed of gold or silver sheet material and attached to the underside of sheet material 52.

Figure 6:
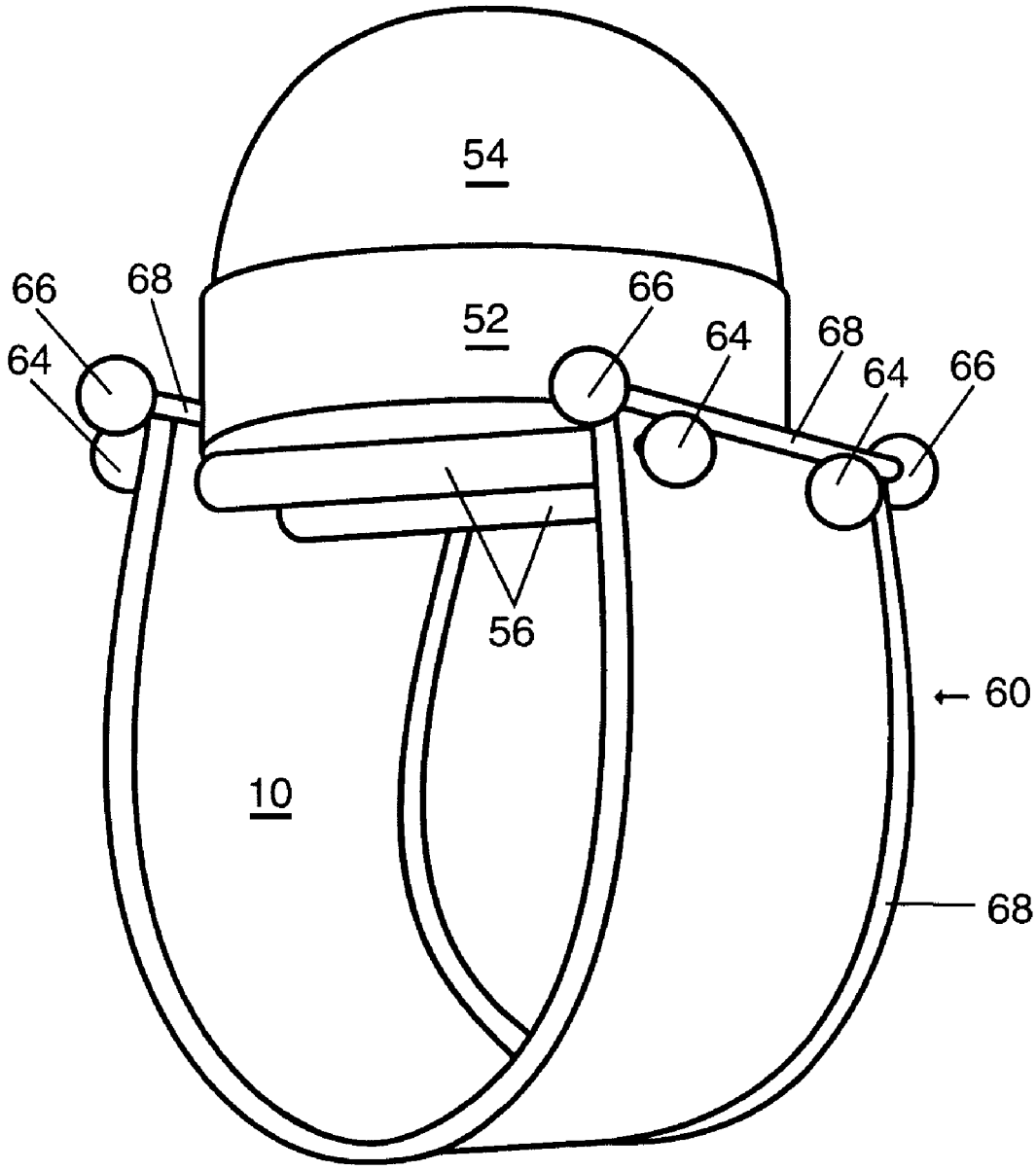
FIG. 6 illustrates an alternate embodiment of the present invention.
Figure 7A:
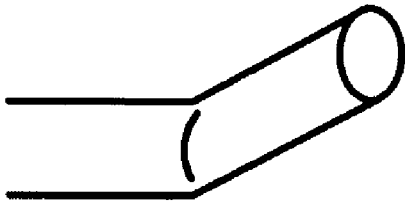
FIGS. 7A–E illustrate various retainer embodiments usable with the present invention.
Figure 7B:
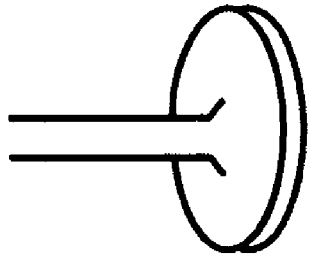
Figure 7C:
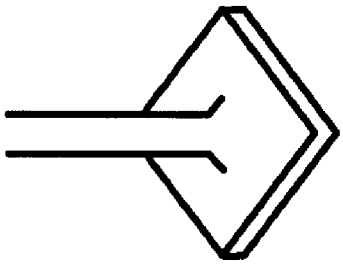
Figure 7D:
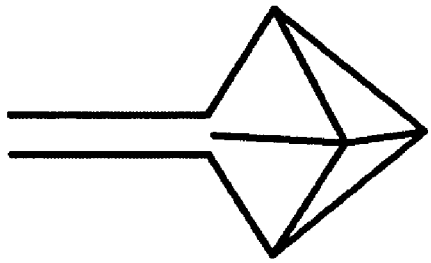
Figure 7E:
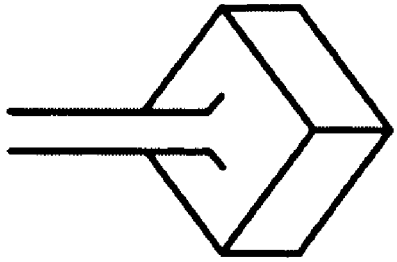

An example of bezel 50 in an assembled ring 60 is illustrated in FIG. 6. As is typical of an assembled ring of the present invention, the holes in the shank 10 and the bars that attach the shank 10 to the bezel 50 are not visible, but are used in conjunction with ferrules 56 and retainers 64 to assemble the ring 60. The ring 60 can preferably include additional ornamental elements such as ornamental, but non-functional retainer-like elements 66, bars 68 (preferably gold or silver) on the edges of shank 10 (which can perform the function of covering the sheet edge with a more comfortable rounded edge), and ornamentation on the outer surface of shank 10. As before, the ring in its assembled state can be dimensioned to allow the bezel to "float" or slide a small amount on the bars.

Figure 8A:
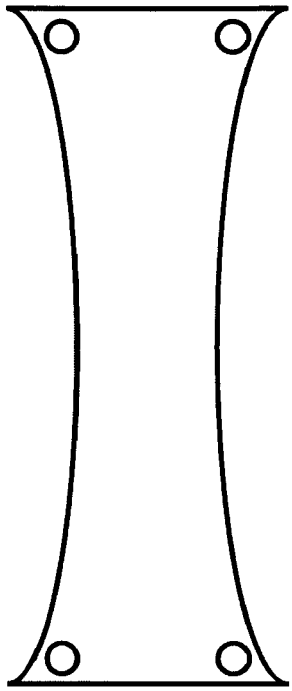
FIGS. 8A–E illustrate various shank embodiments usable with the present invention.
Figure 8B:
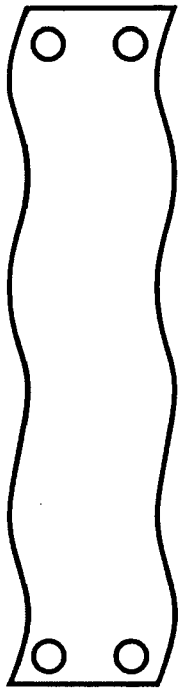
Figure 8C:
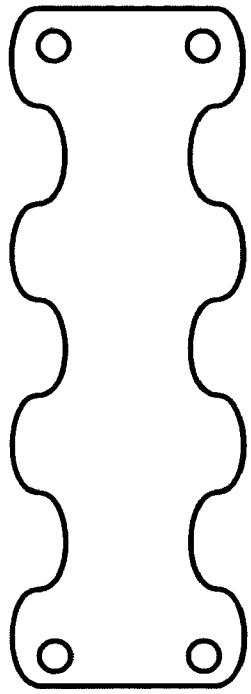
Figure 8D:
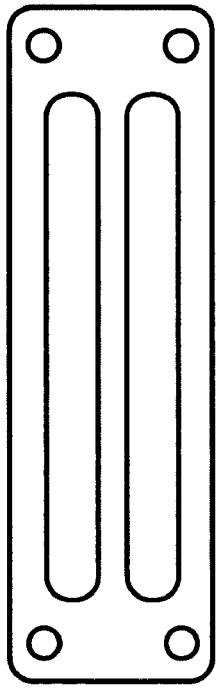
Figure 8E:
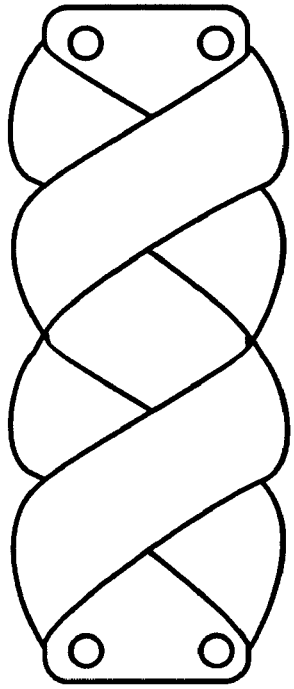

Although the basic shape of the shank has been illustrated as rectangular in FIG. 1, numerous other shapes can also be used, such as, but not limited to, the hourglass shape shown in FIG. 8A, the wavy shapes shown in FIGS. 8B and 8C, the cutout shape shown in FIG. 8D, and the braided-looking shape shown in FIG. 8E.

Rings of various sizes can be produced by varying the dimensions of the shank and/or the length of the bars and/or the bend in the shank and/or the dimensions of the bezel. In this manner, shanks can be formed in various manners to accommodate various finger sizes, toe sizes, wrist sizes, etc., including custom-sizing from pre-finished sheet material, custom-sizing from raw sheet material, custom-sizing from pre-finished rolls of shank-width sheet material, custom-sizing from raw rolls of shank-width sheet material, and pre-fabricating shanks (either flat or bent into U-shapes) to accommodate standard ring sizes. Likewise, a few standard plaque-type bezels can be manufactured to mount a wide variety of ornamental elements.

Even a ring with a certain shank size can be used to produce rings of various sizes and various amounts of bezel float by varying the bezel size, varying the shank bend, and/or varying the bar length. In this manner, ring size and comfort can be fine-tuned. Additionally, the aesthetic designs can be varied or customized by varying the materials, varying the surface pattern of the sheet material on the shank, varying the ornamentation on the shank, varying the ornamentation of the retainers on the bars, and varying the ornamental aspect of the upper portion of the bezel.

As previously mentioned, silver and gold are the preferred materials for the ring components, although this is not meant as a limitation. Any suitable material can be used, including, but not limited to, metals such as stainless steel, platinum, titanium, aluminum, nickel, copper, zinc, and combinations and alloys thereof, as well as stone, clay, ceramics, plastics, and wood. As used herein, all mention of metals includes the associated pure metal and all alloys thereof. For example, "copper" includes pure elemental copper, commercial grades of copper, brass, bronze, etc. Furthermore, although disclosed with reference to a finger ring, the present invention can also find utility for other rings, including, but not limited to, toe rings, bracelets, and napkin rings. Thus, for purposes of this technical description and the claims that follow, the term "ring" should be read broadly to encompass these and other similar embodiments. For example, a watch can be mounted on the bezel, such that a watchband can be formed as the "ring" of the present invention.

The present invention provides for a ring that can be constructed by individuals of varying skill levels. Jewelers can use standard jeweler tools and techniques to assemble the ring components and can either purchase prefabricated components, fabricate the components from raw materials, or fabricate the components from pre-finished sheet and wire materials. Artists and hobbyists can purchase prefabricated components and use simpler assembly techniques such as bending, gluing with adhesives, and threaded components to assemble the ring of the present invention.

Although disclosed herein with respect to a few particular embodiments, one of skill in the art would recognize that various other embodiments, such as forming the components of plastic to be assembled in a snap-together manner to make a toy ring kit, can be formed without departing from the scope of the invention, which is limited only by the claims.

What is claimed is:

1. A ring, comprising:

a substantially U-shaped shank, having opposing first and second ends, the first and second ends each having a plurality of holes defined therethrough;

a bezel having an outer edge, an upper portion for ornamentation and a lower portion having a plurality of ferrules positioned to provide an interconnection between the plurality of holes in the first and second ends of the U-shaped shank;

a plurality of bars transversely disposed between the first and second ends, the bars extending through the plurality of holes of the first and second ends and the plurality of ferrules; and retainers at either end of each of the plurality of bars thereby connecting the shank and bezel to each other, whereby rotation of the bezel is prevented.

2. The ring of claim 1, wherein the shank, bezel, and bars are dimensioned to allow the bezel to slide a short distance along the bars.

3. The ring of claim 1, wherein a major portion of the substantially U-shaped shank is formed of sheet material.

4. The ring of claim 3, wherein the sheet material is selected from the group consisting of gold sheet, silver sheet, pre-finished gold sheet, pre-finished silver sheet, copper sheet, pre-fished copper sheet, titanium sheet, pre-finished titanium sheet, aluminum sheet, and pre-finished aluminum sheet.

5. The ring of claim 1, wherein a major portion of the bezel is formed of sheet material.

6. The ring of claim 5, wherein the sheet material is selected from the group consisting of gold sheet, silver sheet, pre-finished gold sheet, pro-finished silver sheet, copper sheet, pre-finished copper sheet, titanium sheet, pre-finished titanium sheet, aluminum sheet, and pre-finished aluminum sheet.

7. The ring of claim 5, wherein the ferrules of the bezel are formed of the sheet material.

8. The ring of claim 1, wherein the shank has two holes in each of the first and second ends, the bezel has two ferrules, and two bars extending through the holes of the shank and ferrules.

9. The ring of claim 1, wherein the bars are wires.

10. The ring of claim 1, wherein the first and second ends of the bars extend beyond the outer edge of the bezel to allow the bezel to slide a short distance along the bars.

* * * * *